United States Patent [19]

Schriner et al.

[11] Patent Number: 5,014,062

[45] Date of Patent: May 7, 1991

[54] ELECTRONIC PROJECTILE IMPACT SPOTTING DEVICE

[75] Inventors: David A. Schriner, King George; Albert W. Lauer III, Fredericksburg, both of Va.

[73] Assignee: The United States of America as represented by the Secretary of the Navy, Washington, D.C.

[21] Appl. No.: 420,758

[22] Filed: Nov. 23, 1973

[51] Int. Cl.[5] ..... H01S 13/00; F42C 11/02

[52] U.S. Cl. ..... 342/68; 102/210; 102/207.8; 102/214; 310/339; 361/260

[58] Field of Search ..... 325/115, 119, 106; 102/70.2 GA, 210, 202.8, 214; 310/339; 342/68; 361/260

[56] References Cited

U.S. PATENT DOCUMENTS

| | | | |
|---|---|---|---|
| 2,442,176 | 6/1987 | Benioff | 325/119 |
| 2,931,897 | 4/1960 | Tuve et al. | 325/115 |
| 3,106,161 | 10/1963 | Wallbaum et al. | 102/210 |
| 3,269,314 | 8/1966 | Varian | 102/214 |
| 3,329,952 | 7/1967 | Bogle | 342/68 |
| 3,349,709 | 10/1967 | Vibajo | 102/210 |
| 3,540,377 | 11/1970 | Juliano et al. | 102/210 |
| 3,585,419 | 6/1971 | Andre | 102/70.2 GA |

*Primary Examiner*—Thomas H. Tarcza
*Assistant Examiner*—David Cain
*Attorney, Agent, or Firm*—John D. Lewis; Kenneth E. Walden

[57] ABSTRACT

A spark gap transmitter mounted in the base plug of a projectile and powdered by the piezoelectric effect of ferroelectric crystals deformed upon projectile impact. The transmitter emits an RF pulse train in the S-band which may be detected by appropriate equipment which compares the impact point with the target location for aim point correction purposes.

7 Claims, 1 Drawing Sheet

ELECTRONIC PROJECTILE IMPACT SPOTTING DEVICE

BACKGROUND OF THE INVENTION

Historically, long range gunfire correction has been achieved by the use of high powered optical devices or by spotter personnel in the vicinity of the target. Both methods are limited by such items as exposure of spotting personnel, terrain, weather, darkness, and the capability to visually acquire both the target and impacting rounds. Even under the best of conditions, range and angle estimation errors, parallax, or failure to visually spot the impacting rounds has led to the expenditure of extra ammunition in order to adjust fire. When either the gun platform or the target is in motion, the problem of correcting fire becomes even more acute.

The USAF, AC-130 gunship has, as its primary mission, the destruction of enemy supply lines. A typical mission may include an attack on moving targets such as trucks or armored vehicles. Efficient utilization of ammunition stores during a tactical mission is highly desirable and eventually will have a significant effect upon the effectiveness of military commitments by enemy forces. The AC-130 gunship employs a highly sophisticated electronic system to accomplish its mission of interdiction. The ASD-5 equipment, which is part of this system, has the capability of detecting individual motorized targets without regard to weather or darkness. The ASD-5 also has the capability of receiving and displaying S-band electromagnetic transmissions from the target vicinity and of comparing the location of any such signal with the location of the target image. A logical extension of this detection capability was the concept of an impact marker installed in the 40 mm ammunition used by the gunship. If the impact point of the round can be determined in reference to the target location, a correction may be made in aim point which should greatly increase the probability of a direct hit by the following round. Since the Low Light Level TV and Infra-Red sensors in current use aboard the gunships have only a clear weather capability of providing miss data, the electronic impact marker would allow extension of gunship operations to a true all weather capability.

Gunship equipment includes a monopulse, DF receiver integrated into the fire control system. RF signals transmitted by an electronic impact marker are displayed as a small cluster of spots on the ASD-5 screen. Position of the spot cluster is seen in relation to the target image. An angle gate is displayed on the screen as a rectangular figure enclosing the target image and is controllable as to position on the screen by the gunfire control operator. Positioning of the antenna remotely positions the pilot's sighting pipper, thus, allowing the necessary fire control correction.

SUMMARY OF THE INVENTION

The present invention is a projectile mounted electronic spotting device for transmitting an RF pulse train detectable prior to detonation of the projectile for determining its impact point. More particularly, a spark gap transmitter is provided within a base plug housing. Upon impact a plurality of ferroelectric crystals are compressed via a conduction pad or pusher plate to create a piezoelectric effect. The voltage thus created across the crystals results in a breakdown at an annular spark gap when a sufficient voltage is reached as conducted through a conduction pad interfacing the positive side of the crystals. The energy of this voltage breakdown is converted into an RF pulse train via an R-C antenna which resonates at the occurrence of the breakdown voltage due to shock excitation. The rise time is determined by the geometry of the transmitter elements and must be sufficient to allow a detectable number of RF pulses to be generated before the detonation time of the fuse of the projectile.

OBJECTS OF THE INVENTION

It is a primary object of this invention to provide an electronic device for inclusion in a projectile which will generate and transmit an RF pulse train upon impact of the projectile.

It is another object of this invention to provide an electronic device for inclusion in a projectile which upon impact will generate S-band electromagnetic transmissions which may be detected by appropriate equipment.

It is a further object of this invention to provide an electronic projectile impact spotting device which enables all weather detection of the point of projectile impact.

Other objects, advantages and novel features of the invention will become readily apparent upon consideration of the following detailed description of the invention when considered in conjunction with the accompanying drawings wherein:

DESCRIPTION OF THE PREFERRED EMBODIMENT

Figure 1:
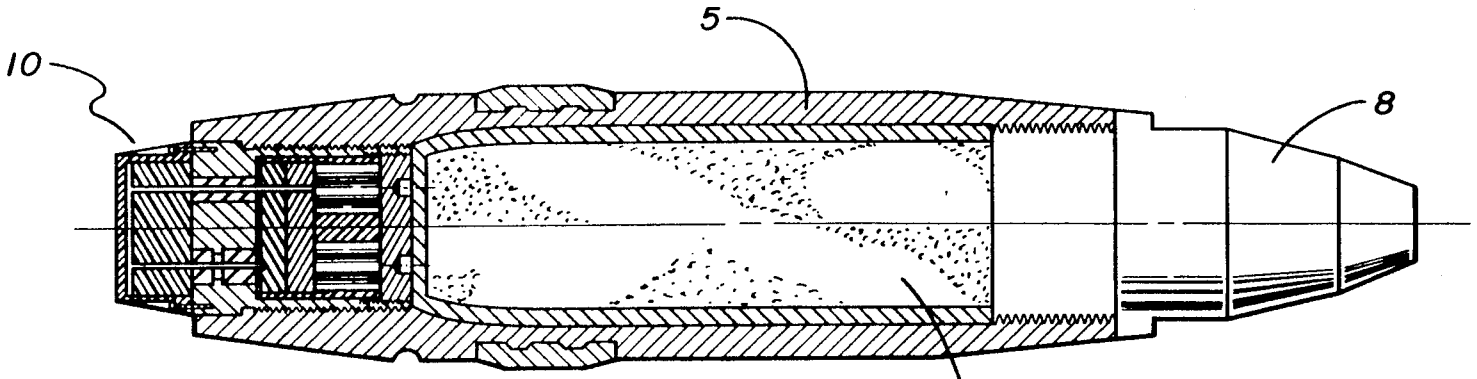
FIG. 1 is a sectional view of a projectile incorporating the electronic impact spotting device of the present invention.

Attention now is directed to the drawings, wherein like numerals of reference designate like parts throughout the several views, and more particularly to FIG. 1 wherein there is disclosed a projectile comprising a projectile body 5, an explosive charge 6, and a point detonating fuze 8. The conventional base plug of such a projectile has been replaced by the electronic impact spotting device of the present invention which is designated generally by the reference numeral 10.

Figure 2:
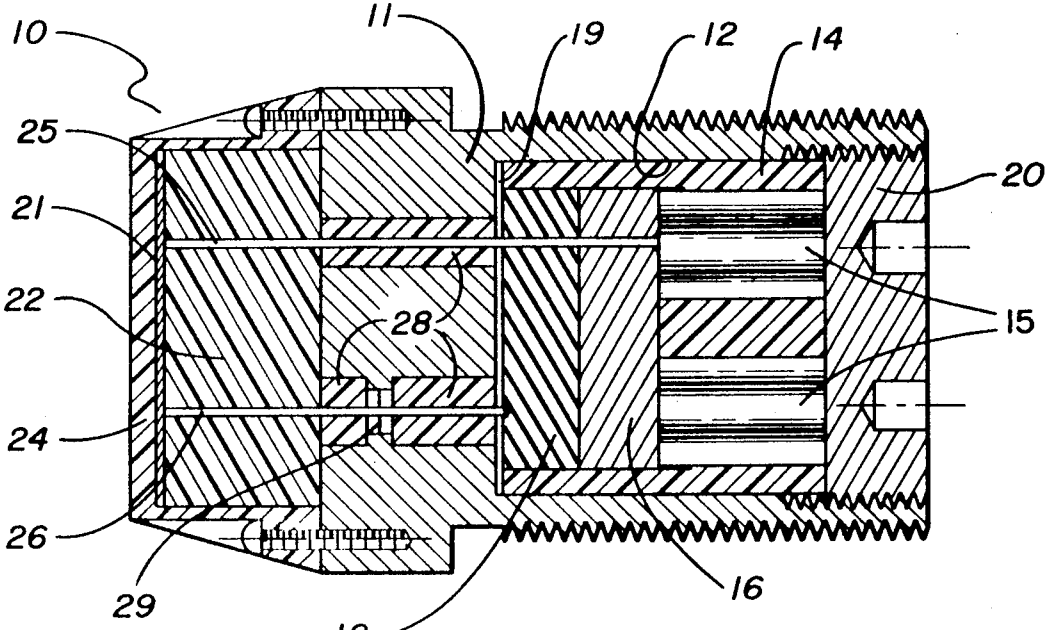
FIG. 2 is an enlarged sectional view of the electronic impact spotting device of the present invention illustrating the details of construction.

Referring now to FIG. 2 there is shown a transmitter housing 11 which may be made of mild steel or other appropriate material. Mechanically, the transmitter housing is responsible for spotting and protecting the transmitter components and remains at ground potential during the operational period of the device. The transmitter housing 11 is provided with a cylindrical aperture 12 within which is disposed a cylindrically configured insulating ring 14 which may be formed of lexan polycarbonate or other suitable insulating material. A plurality of ferroelectric crystals 15 is disposed within cylindrical apertures in the insulating ring 14 and with the positive ends thereof facing to the left as shown in FIG. 2. A conduction pad 16, which may be brass or other suitable electrically conductive material, is disposed within the insulating ring 14 in physical contact with the positive ends of the ferroelectric crystals. A spacer 18, formed of neroprene or other resilient insulated material, is disposed within the insulating ring 14 and abutting the conduction pad 16. A mica disc 19 is interposed between the bottom of the aperture 12 and the insulating ring 14 and spacer 18. A transmitter end plug 20 is threaded into the open end of the aperture 12 and serves to confine the aforedescribed parts within the transmitter housing during impact deceleration. The end plug 20 also engages the negative ends of the ferroelectric crystals 15 and thus serves to provide continuity of the electric circuit to ground as represented by the transmitter housing 11.

A disc shaped antenna 21, which may be brass or other electrically conductive material, is provided and is confined to the position shown in FIG. 2 by means of an antenna seat 22 and an antenna protector 24 fastened to the transmitter housing 11 as shown. The antenna seat 22 and protector 24 may be formed of glass-impregnated epoxy or other appropriate materials. A first lead wire 25 connects the antenna 21 to the conduction pad 16. A second lead wire 26 is silver-soldered to the antenna 21. The lead wires 25 and 26 project through apertures formed in the transmitter housing 11 and are insulated therefrom by means of polycarbonate insulators 28. A reduced diameter portion of the aperture in the transmitter housing 11 surrounding the lead wire 26, together with the adjacent portion of the lead wire 26, defines an annular spark gap 29.

OPERATION

In order that a better understanding of the invention may be had, its mode of operation will now be described.

When the projectile is gun launched, set-back forces will slightly compress the spacer 18 due to the inertia of the conduction pad 16 and this in turn allows the negative ends of the crystals 15 to move out of electrical contact with the end plug 20. The mica disc 19 serves to prevent any moisture in the neoprene spacer 18 from providing a leakage path to ground. Thus, any deflection of the crystals 15 during launch will not result in a transmitted signal since the crystals 15 are ungrounded. After the projectile clears the gun tube and is no longer accelerating, the neoprene spacer 18 is free to relax and move the negative ends of the crystals 15 into electrical contact with the end plug 20.

The present invention begins to operate on impact of the projectile, either with a target or with anything else in its vicinity. The deceleration forces cause compression of the crystals 15 between the conduction pad 16, which functions as an inertial mass, and the end plug 20 which in turn causes generation of a voltage across each crystal 15 due to the piezoelectric effect. This voltage is impressed across the annular spark gap 29; the positive voltage being applied through conduction pad 16, lead wire 25, antenna 21, and lead wire 26; and the negative voltage or ground potential being applied through end plug 20 and transmitter housing 11. When the potential reaches the design value, a breakdown occurs across the spark gap 29 causing the antenna 21 to be shock-excited. The antenna 21 then resonates at a rate determined by the time constant of the circuits R-C value and this energy is transmitted as a train of RF pulses in the S-band until destruction of the transmitter resulting from detonation of the projectile.

The detonation time of point detonating fuzes currently in use is on the order of 5 milliseconds, i.e. approximately 5 milliseconds after projectile impact, the explosive charge will be detonated resulting in destruction of the projectile and transmitter. On the other hand, only 20 microseconds of transmitter operation is required by the gunship receiver equipment to properly identify the impact point. If the detonation time is 5 milliseconds, approximately 1,000 pulses will be transmitted, since in the preferred embodiment of the present invention, voltage rise and breakdown will occur on the order of once every five microseconds. Due to design characteristics, the ASD-5 equipment will accept only one burst of this RF energy each 20 microseconds; therefore, approximately 250 bursts of broad band energy will be received during the detonation time of the projectile. The voltage time, and, thus, the pulse rate, is a function of the mechanical system design. If a greater force per unit of time is applied to the crystals, the time decreases. If less force is applied, the time increases. The voltage rise time of the system, then, is directly proportional to the mass of the conduction pad/neoprene spacer/crystal combination and the deceleration of the projectile as it impacts.

In a tactical situation the target would be acquired on the ASD-5 by the interception of a noise pattern generated by certain characteristics of the mechanical targets. If the target were obscured by weather or heavy smoke, a marker round would be fired at the aim point computed by the gunship's acquisition and gun laying system. When the round impacted, the transmitter in the base plug would operate and a dot cluster would appear on the ASD-5 screen. This dot cluster would then be used as a basis for sighting corrections if the round missed the intended target. The antenna center axis would be manually driven to the position of the dot cluster, offsetting the pilot's pipper by the amount of miss distance. The pilot would then fly the AC-130 gunship so as to reacquire the target and fire for effect. The act of lining up the antenna axis with a known impact memory point serves the purpose of boresighting the sighting system.

Obviously, many modifications and variations of the present invention are possible in the light of the above teachings. It is therefore to be understood that within the scope of the appended claims the invention may be practiced otherwise than as specifically described.

What is claimed is:

1. An electronic device adapted to be incorporated into a projectile and operable upon projectile impact to emit an electro-magnetic signal marking the point of projectile impact comprising:

an electrically conductive housing adapted to form the end plug of a projectile;

piezoelectric means disposed within said housing;

an electrically conductive inertial mass disposed within said housing in engagement with one terminal of said piezoelectric means and operable upon projectile impact to force the other terminal of said piezoelectric means against said housing and generate a voltage across said piezoelectric means;

an antenna;

a first lead electrically connecting said antenna to said inertial mass; and a second lead electrically connected to said antenna and disposed adjacent a portion of said housing to define a spark gap whereby said antenna will resonate and emit an RF pulse train when the voltage generated across said piezoelectric means exceeds the breakdown voltage of said spark gap.

2. An electronic device as defined in claim 1 wherein said piezoelectric means comprises a plurality of ferroelectric crystals.

3. An electronic device as defined in claim 2 wherein said inertial mass comprises a metal disc engaging the positive terminals of said ferroelectric crystals.

4. An electronic device as defined in claim 3 wherein an insulating ring encompasses said inertial mass and said ferro-electric crystals and insulates them from said housing; the negative terminals of said ferroelectric crystals projecting through said insulating ring and normally engaging one end of said housing and in electrical contact therewith.

5. An electronic device as defined in claim 4 wherein a resilient spacer is interposed between said inertial mass and the other end of said housing whereby said inertial mass and said ferro-electric crystals may move under the influence of set-back forces of projectile launch to interrupt electrical contact between the negative terminals of said ferroelectric crystals and said housing during projectile acceleration.

6. An electronic device as defined in claim 5 wherein said antenna is a broad band antenna projecting rearwardly of said housing and rigidly supported during gun launch and projectile impact by means which are substantially transparent to electro-magnetic radiation.

7. An electronic device as defined in claim 6 wherein the RF pulse train emitted when the antenna resonates is in the S-band.

* * * * *